US007478450B2

(12) United States Patent
Fong

(10) Patent No.: US 7,478,450 B2
(45) Date of Patent: Jan. 20, 2009

(54) LONGITUDINALLY OFFSET BRIDGE SUBSTRUCTURE SUPPORT SYSTEM

(76) Inventor: Charles Fong, 670 Weadley Rd., Radnor, PA (US) 19087

( * ) Notice: Subject to any disclaimer, the term of this patent is extended or adjusted under 35 U.S.C. 154(b) by 464 days.

(21) Appl. No.: 11/289,080

(22) Filed: Nov. 29, 2005

(65) Prior Publication Data

US 2007/0119004 A1 May 31, 2007

(51) Int. Cl.
*E01D 21/00* (2006.01)

(52) U.S. Cl. ..... 14/77.1; 14/20; 14/21; 14/22; 14/23

(58) Field of Classification Search ..... 14/18–23, 14/77.1

See application file for complete search history.

(56) References Cited

U.S. PATENT DOCUMENTS 680,906 A * 8/1901 Arnodin ..... 14/8
4,009,579 A * 3/1977 Patzner ..... 405/138
4,907,312 A * 3/1990 Yang et al. ..... 14/21
5,072,474 A * 12/1991 Dilger et al. ..... 14/77.1
5,896,609 A 4/1999 Lin
6,446,292 B1 * 9/2002 Fuessinger et al. ..... 14/2.4
6,721,985 B2 * 4/2004 McCrary ..... 14/77.1
2004/0111815 A1 * 6/2004 Fuessinger et al. ..... 14/77.1

FOREIGN PATENT DOCUMENTS

| | | |
|---|---|---|
| JP | 08-003921 | 1/1996 |
| JP | 2002-294627 | 10/2002 |
| KR | 10-2003-0012013 | 2/2003 |
| KR | 10-2005-0025455 | 3/2005 |
| KR | 10-2006-0075508 | 7/2006 |

* cited by examiner

*Primary Examiner*—Raymond W Addie
(74) *Attorney, Agent, or Firm*—Fox Rothschild LLP

(57) ABSTRACT

This invention provides a novel construction method to longitudinally offset a traditional bridge substructure to a desired location by utilizing unconventional link-support or alternative support systems. This invention describes an approach to achieve longer span length, wider opening and/or greater lateral underclearance for the needed facility below a bridge span that no other traditional bridge construction methods could provide.

10 Claims, 7 Drawing Sheets

ELEVATION

ELEVATION

200A
℄ Brg. Abut.
℄ Pier
212
214
216
℄ Roadway
218
Shldr.
2-Traffic Lanes
Median
2-Traffic Lanes
220
Shldr.
℄ Pier
℄ Brg. Abut.
ELEVATION - EXISTING 200B
℄ Super-Col.
224
℄ Brg. Abut.
226
℄ Cap Bm.
230
Retaining Wall
℄ Roadway
Full Shldr.
3-Traffic Lanes
Median
3-Traffic Lanes
Full Shldr.
℄ Cap Bm.
228
Cables or Tie-Rods
232
℄ Super-Col.
222
℄ Brg. Abut.
226
ELEVATION - RETROFIT

ELEVATION - EXISTING

ELEVATION - REHABILITATION

ELEVATION

ELEVATION

SECTION A-A

ELEVATION

ELEVATION - EXISTING

ELEVATION - RETROFIT

LONGITUDINALLY OFFSET BRIDGE SUBSTRUCTURE SUPPORT SYSTEM

BACKGROUND OF THE INVENTION

The span lengths of a traditional short span bridge is limited by the length of the bridge's beams and/or girders. For an existing bridge, when a length extension of a span is needed, the traditional solution is to replace the existing span or bridge with a new, longer span or bridge. This invention, instead, could provide longer spans by relocating traditional substructure supports from the traditional beam support locations to the desired longitudinally offset locations. Therefore, the same beams/girders provide a longer bridge span with shorter beam/girder lengths or smaller member sections. This invention increases the bridge span length, opening between substructures, or lateral underclearance of either a new or existing bridge (or span) by constructing this "longitudinally offset bridge substructure support system" while saving in construction cost as well as construction time.

When a facility underneath a grade separation overpass bridge or similar structures must be expanded or widened, it is always difficult and expensive using traditional methods to rebuild the structure with longer beams or girders. The underneath existing supporting substructures (piers or abutments) limit the expansion/widening of the facility.

SUMMARY OF THE INVENTION

This invention is to resolve the above-discussed problems. To construct a bridge using this invention, the offset support substructures (configured with any acceptable construction material) and their corresponding foundations are constructed at desired longitudinal offset locations away from conventional beam support pier/abutment locations. This invention provides the extra lateral underclearance, opening, or span length between bridge substructures to meet the needs of the facility below the span. In addition, a link-support system is necessary to support the bridge beams (with shorter lengths and/or weaker sections than traditionally designed beams) at an offset distance to the offset support. This invention can be used for new-construction, retrofitting, or rehabilitation of bridge structures. This invention can also utilize any applicable construction materials, such as: structural steel, CIP or pre-cast concrete, pre- or post-tensioned prestressed concrete, fiber reinforced polymer (FRP) composites, etc.

The procedure to construct "longitudinally offset bridge substructure support system" varies, depending on site conditions and/or other requirements. One approach, with various types of construction materials, such as: structural steel, pre-tensioned/post-tensioned pre-stressed concrete, FRP composites, or a combination, etc., the pier cap beam or similar configurations can be constructed either "below" (if there is sufficient vertical clearance) or "integrally" within the bridge superstructure. If the pier cap is an integral cap, the depth of the cap beam is about the same as that of the bridge beam or girder at the cap location; therefore, the cap beam does not reduce or limit the bridge's vertical underclearance. At the least, one substructure support, such as a super-column (concrete, steel or any applicable construction material), on each side of the bridge superstructure needs to be constructed as the "offset supports" at desirable locations offset longitudinally (or offset both ways: longitudinally & transversely). The support super-columns could be either vertical or slanted to reduce bending. This offset support combines a "link-support system", of cable, tension tie-rods, framing, cantilever, or a combination, etc. of any construction material, to support the cap beam from the offset supports, which in term supports the bridge's superstructure. If the offset distance is large, it is possible to use tie-downs and/or counter-weights (an adjacent substructure could be used as counter-weights) to reduce the large cantilever force applying to the offset support of super-column and its foundation.

Another way to construct the longitudinally offset substructure support is to construct the "offset supports" at the desired locations in the forms of walls, columns, beam/column framing, or a combination, etc. At the traditional beam support location, where the traditional substructure is eliminated, construct beam-to-beam connections to provide continuity of the bridge span for the case of simple spans, or strengthen/modify the continuous span beams. At the other traditional beam-end location(s), construct tie-downs and/or counter weights to counteract the extra cantilever or negative moment forces as required.

BRIEF DESCRIPTION OF THE DRAWINGS

The following drawings with reference numbers and exemplary embodiments are referred for explanation purposes.

DETAILED DESCRIPTION OF THE INVENTION

Figure 1:
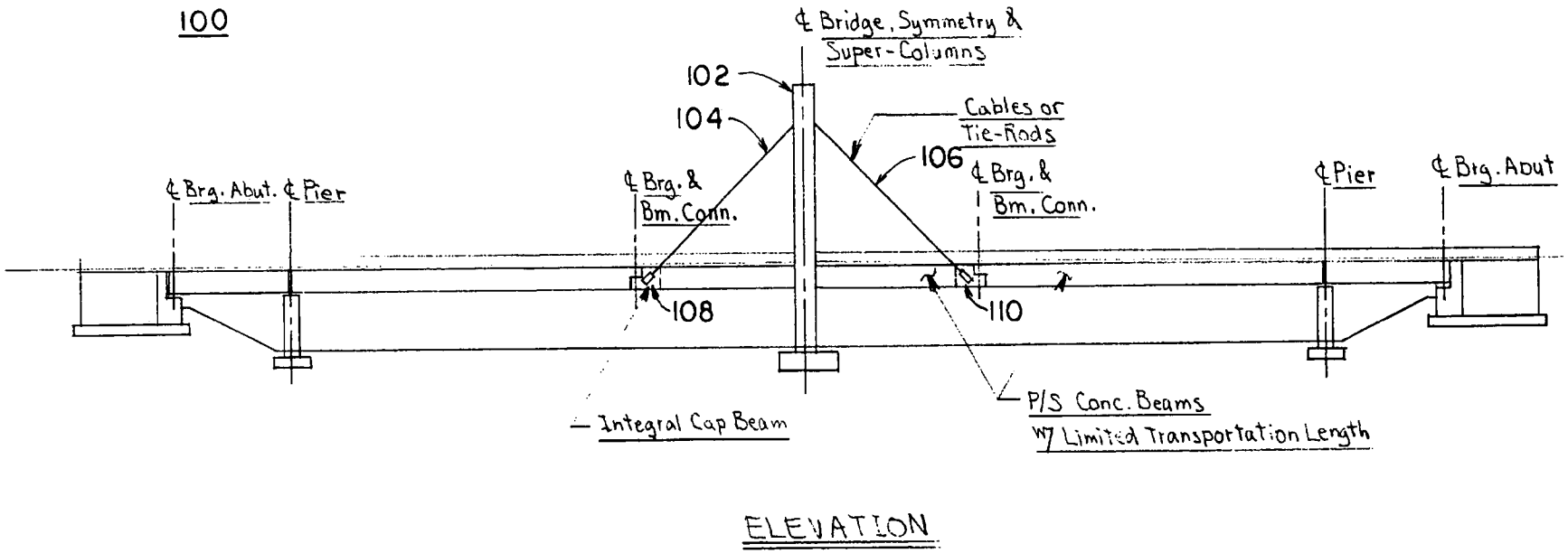
FIG. 1 illustrates the elevation view of a new bridge constructed using this invention.

Referring to FIG. 1, a new bridge is implemented with this invention having one super-column (102) on each side of the bridge as the longitudinally offset substructure supports. The super-columns, which offset longitudinally from beam-end (or beam support) locations, in this case are located at the center of the bridge. The link-support system is made up of cables (104, 106) anchored at top of super-columns and extended down to support the integral cap beams. One end of each cable is anchored to support one end of each cap beam (108, 110), and the other end of each cable is anchored near the top of the super-columns so that the cables can support at offset distances the cap beams that support the weight of the bridge's spans. Without using this arrangement of using the super-column, cable, and integral cap beam as the longitudinal offset substructure support components, this bridge requires more supporting piers underneath, which will take up more space, reduce the span lengths or opening between substructures, and limit the lateral underclearance that can be used below the bridge.

Overall, when using this invention to construct a new bridge or modify an existing bridge, it can be described in following detail steps: First, for the pier (or other substructure), one can build the longitudinally offset supports with their foundations at desired locations of the bridge. Second, one can provide temporary supports for the bridge's superstructure and construct new integral cap beams. If post-tensioned, pre-stressed concrete is used for the cap beams, one must wait for the concrete to reach design strength before applying the post-tensioning. Third, one can install the link-support system composed of cables, tension tie-rods, steel or concrete frames, or a combination, etc. to support the superstructure at offset distance from the offset support. Lastly, one can remove the temporary supports. Referring back to FIG. 1, compared to a traditional pier (or substructure) supporting system, this invention provides extra wide openings between the center "offset support" super-columns and the adjacent piers.

The new bridge construction example shown in FIG. 1 uses pre-cast, pre-stressed concrete beams at near-limit transportation lengths. The set of pre-stressed concrete bridge beams in the middle and centered at super-columns, are supported by the integral cap beams at both ends. This set of bridge beams provide bearing notches as seats for the adjacent sets of pre-stressed concrete bridge beams to bear on and/or tied to the integral cap beams. Besides, to achieve "wider than extra wide" openings for the two center spans, one can use two sets of pre-stressed concrete bridge beams end-to-end in the middle, one set each on each side of the super-column. In addition, it requires a structural support component, between the two mid super-columns, to support the beam ends where the two sets of pre-stressed concrete beam ends meet, in the middle at super-column location.

Figures 2A, 2B:
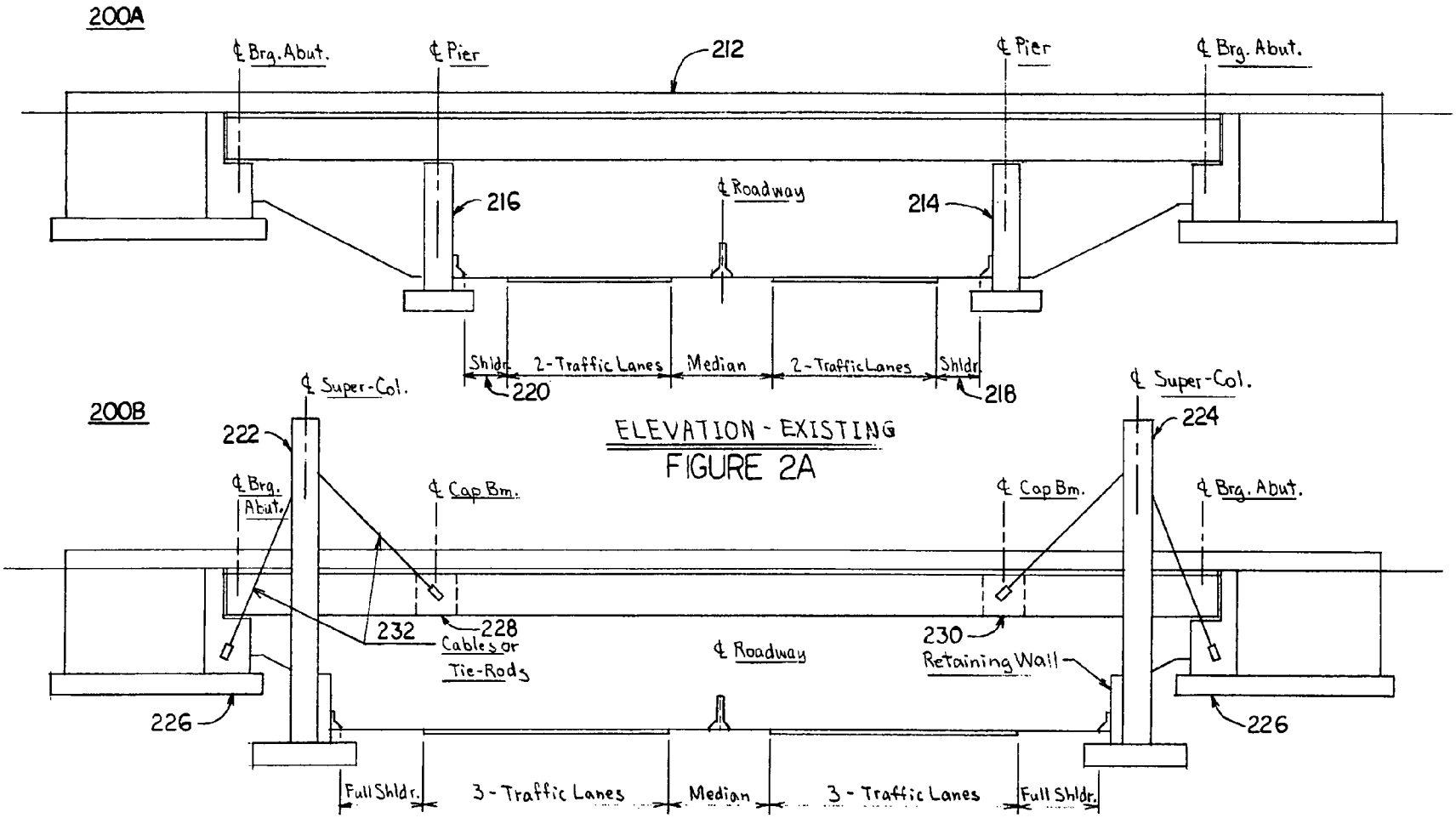
FIG. 2A shows the elevation view of a multi-span bridge constructed by using traditional method.
FIG. 2B illustrates the existing bridge of FIG. 2A modified using this invention, that the underpass four-lane road is widened into a six-lane road.

FIG. 2A shows a grade separation overpass bridge (212) crossing over a four-lane road. The drawing shows the elevation view of a three span continuous multi-beam bridge. This bridge has two piers (214, 216). The road below has outside shoulders (218, 220). When it is necessary to widen the road, it is expensive and difficult to achieve the goal using traditional methods.

However, FIG. 2B illustrates how this invention can achieve the goal of widening the underpass road below the existing bridge of FIG. 2A. First, one must construct the pier offset support super-columns (222, 224) at the desired locations that provide sufficient space for the underpass road widening. Next, integral cap beams (228, 230) must be constructed above the existing piers. Finally, the link-support system cables (232) must be installed by anchoring one end of each cable near the top of the super-columns (222, 224), extending down the cables and anchoring the other ends of the cables: some to the exterior sides of super-columns to abutments (226) and the others to the interior mid-span side to cap beams (228, 230). Once these cables are properly anchored, the existing piers, as temporary supports during construction, can be demolished. By eliminating existing piers underneath the superstructure, the existing 4-lane road has sufficient space to be widened into a six-lane road with full-width shoulders.

Here is a more detailed description of the above example. First, the longitudinally offset supports of super-columns (222, 224) and their foundations must be constructed at the desirable locations by using the existing piers as temporary supports. Second, one must construct the integral cap beams (228, 230). If post-tensioned, pre-stressed concrete would be used for the cap beam, one must wait for the concrete to reach design strength before applying the post-tensioning. Third, the link-support system must be installed as follows: cables (232) must be installed to support the cap beams from the offset support super-columns. Lastly, the existing pier structures can be demolished. This invention provides "extra lanes with full shoulders" for roadway below the bridge, thus avoiding replacing the bridge spans or even the entire bridge structure, and saving construction cost, construction time, and ultimately reducing traffic interruptions.

Figures 3A, 3B:
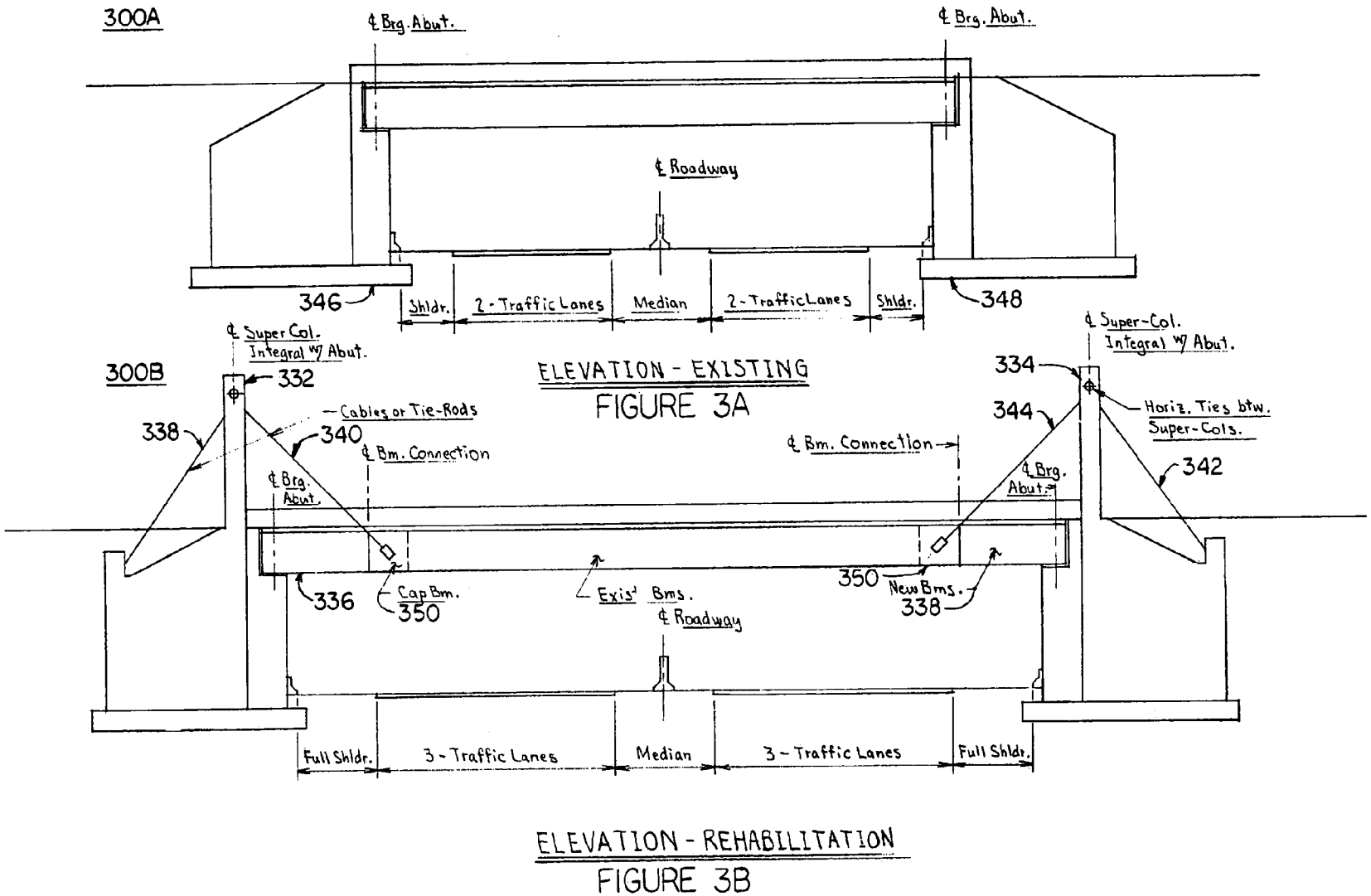
FIG. 3A shows the elevation view of a single span bridge constructed using traditional method.
FIG. 3B illustrates the existing bridge of FIG. 3A modified using this invention, that the underpass four-lane road is widened into a six-lane road.

FIG. 3A shows another example of a grade separation overpass bridge crossing over a four-lane road. The drawing shows the elevation view of a single span multi-beam bridge. To widen the existing road below the bridge, it is necessary to extend the span, as well as the total length of the bridge. Using the traditional method, this procedure requires total replacement of the entire bridge (both super and sub-structures). FIG. 3B illustrates the elevation view of the rebuilt bridge implemented with this invention. First, the longitudinally offset supports of new abutments with super-columns (332, 334) must be constructed, and their foundations placed at desirable locations behind the existing abutments, where the existing abutments (346, 348) may act as temporary supports. (For maintaining the traffic on the overpass, provide temporary spans over the new abutment construction areas.) Second, the integral cap beams (350) must be constructed. If post-tensioned pre-stressed concrete is the choice for the cap beams, one must wait for the concrete to reach design strength before applying post-tensioning. Third, the sets of extension beams (336, 338) are installed spanning between: the existing beam ends above existing abutments and the new abutments. This increases the total span/bridge length. Near the tops of the new abutment super-columns (332, 334), one must install the sets of cables (338, 342) and extend to the new abutment foundations as counter-weights; and one must install the other sets of cables (340, 344) and extend to support the new cap beams. Lastly, the existing abutment structures (346, 348) can be demolished, and the road can be widened below the bridge to accommodate additional traffic lanes with full shoulders.

Figure 4:
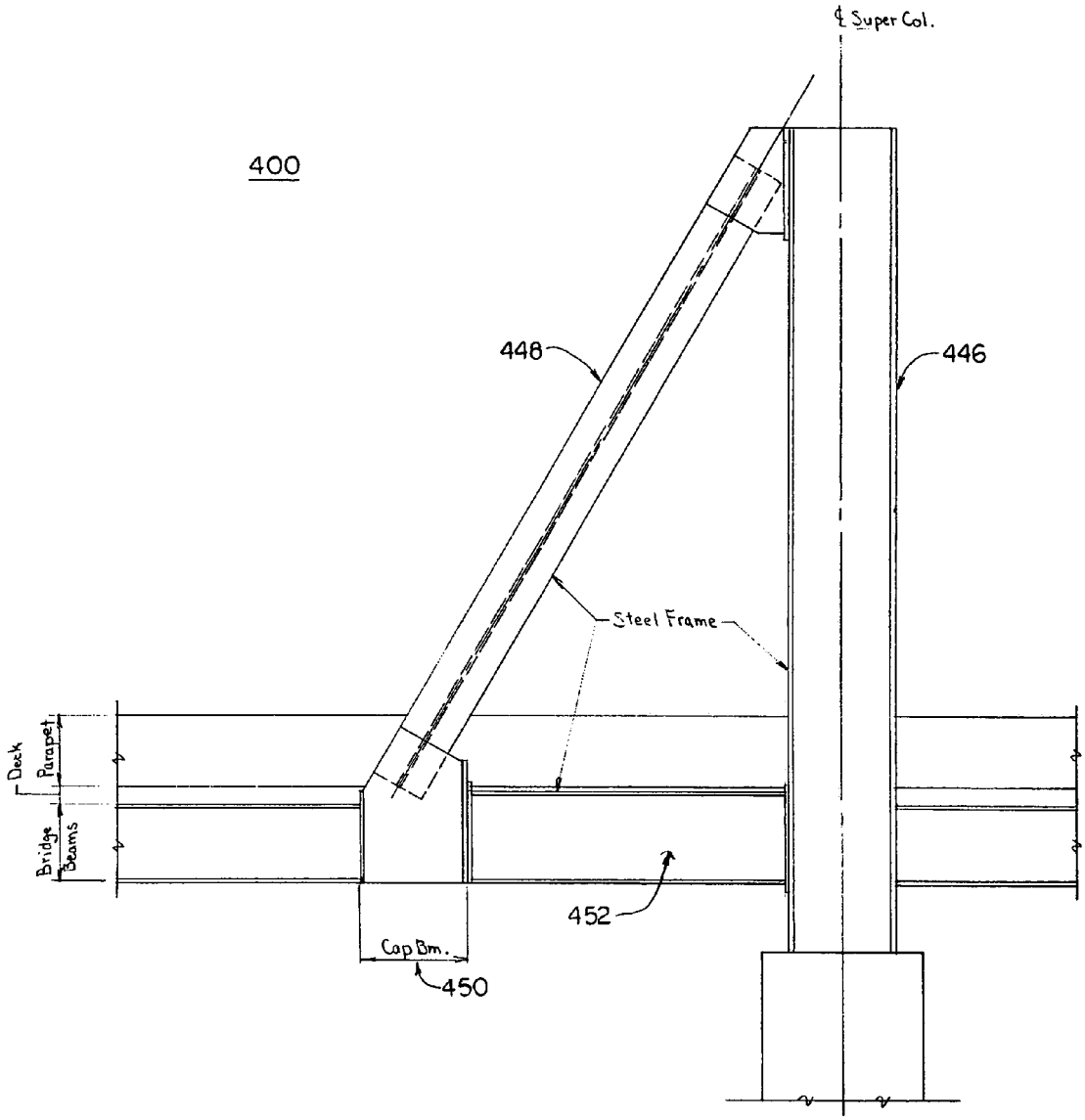
FIG. 4 illustrates elevation view of another embodiment of a link-support system where a steel frame instead of cable being used.

FIG. 4 illustrates another configuration of a link-support system of this invention. Instead of using cables to support the new cap beam (450), a steel frame (446, 448, 452) or any similar framing system built by any material with satisfying specifications can be used.

Figure 5A:
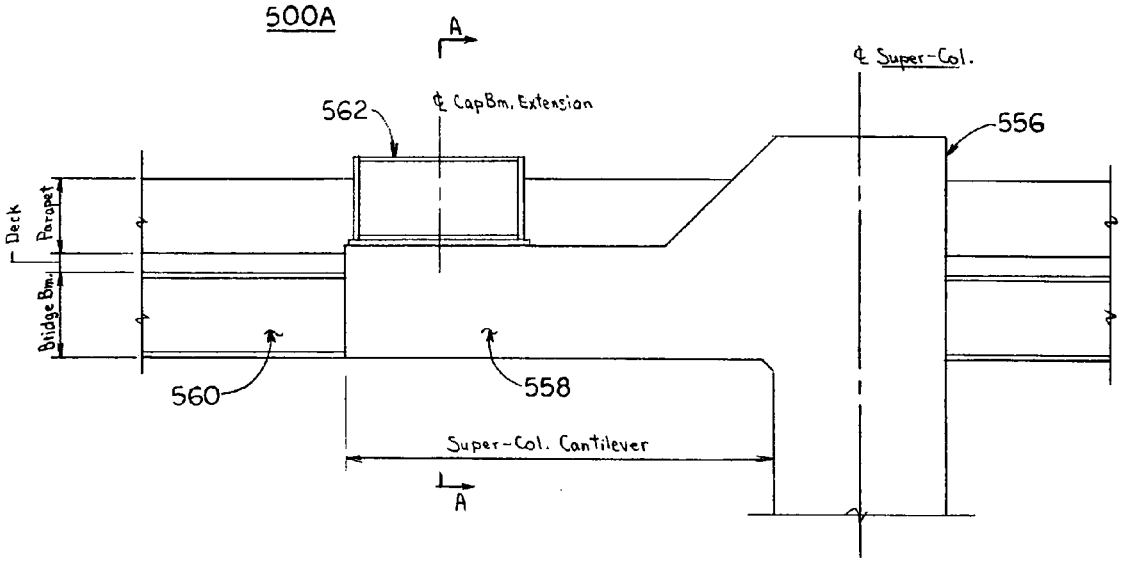
FIG. 5A illustrates the elevation view of a link-support system where a cantilever instead of cable being used.
Figure 5B:
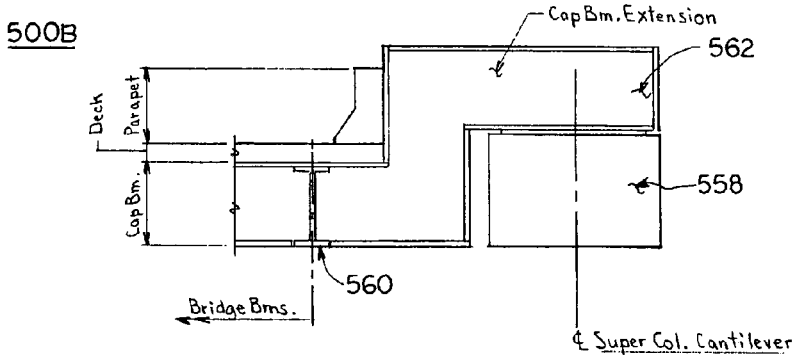
FIG. 5B illustrates the section view of the link-support system of FIG. 5A.

FIG. 5A illustrates another configuration of a link-support system of this invention. Instead of using cables to support the new cap beam (562), a concrete cantilever (558) or any similar cantilever system built by any material with satisfying specifications can be used. FIG. 5B, illustrates the cross section view of FIG. 5A example. As shown in FIG. 5A, the cantilever (558) is an extended part from the offset support of super-column (556), where the new cap beams (562) are seated. FIG. 5B section view shows how the cap beam (562) can be extended and seated on top of the cantilever (558).

Figure 6:
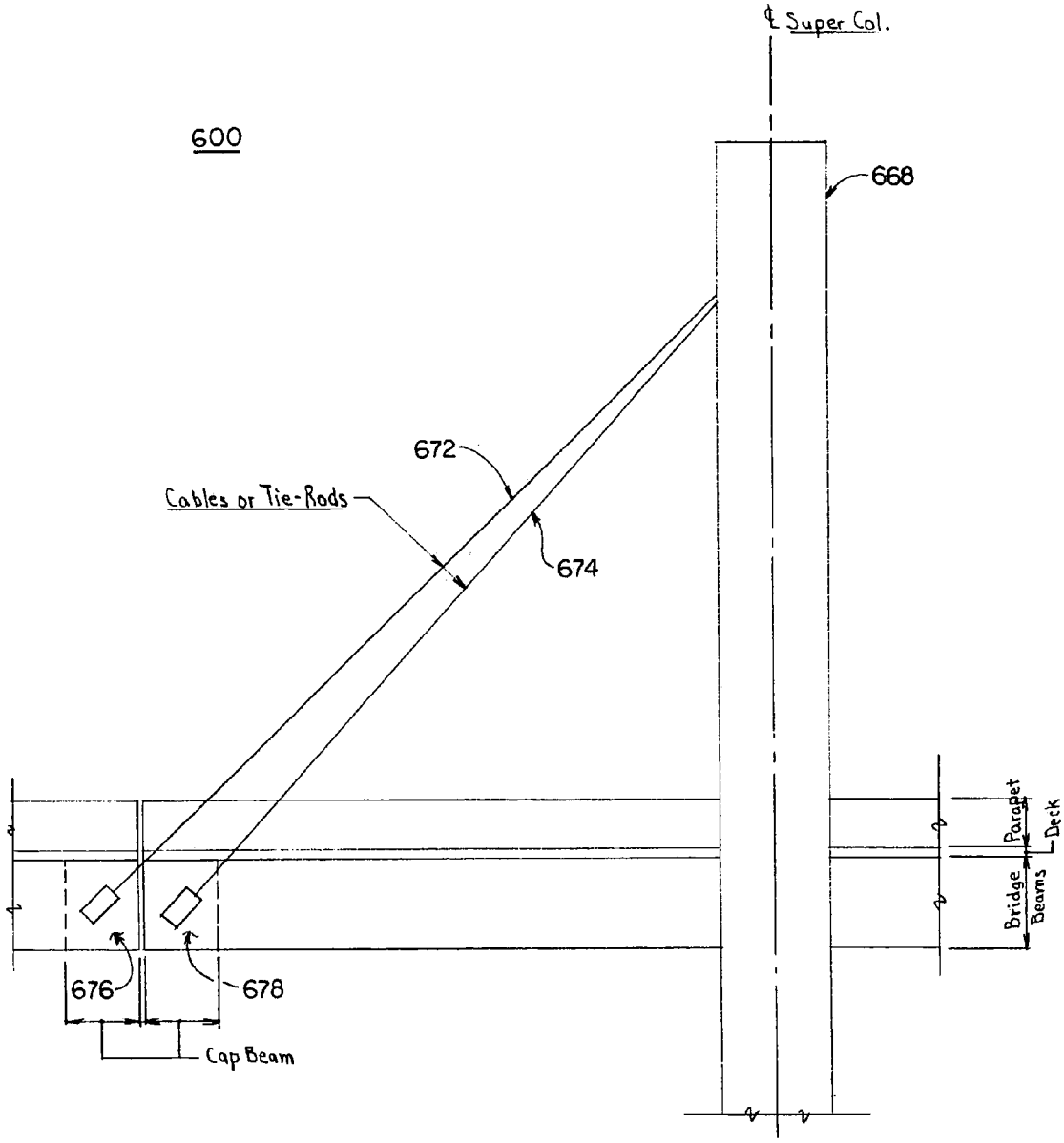
FIG. 6 illustrates the elevation view of the link-support system where multi cables being used.

FIG. 6 illustrates another configuration of a link-support system of this invention. Instead of using one new cap beam, one can use one cap beam (676, 678) on each set of the beam-ends of bridge span, where the two sets of beams of bridge span meet and where the traditional pier support is removed and replaced with offset support at a desired offset location. This link-support system uses multi-cables (672, 674) to support individual cap beams (676, 678). Beam-to-beam connections could be installed to provide a better continuity of the span. This multi-cable link support system could be substituted with any similar multi-cable system built by any material with satisfying specifications.

Figure 7A:
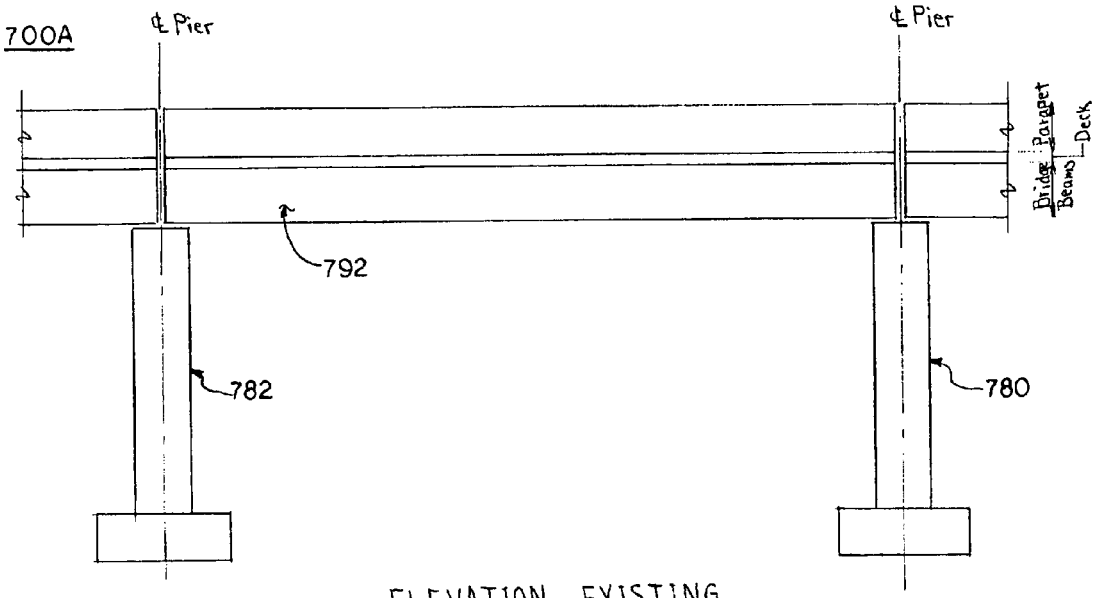
FIG. 7A shows an elevation view of a bridge span constructed by using traditional method.
Figure 7B:
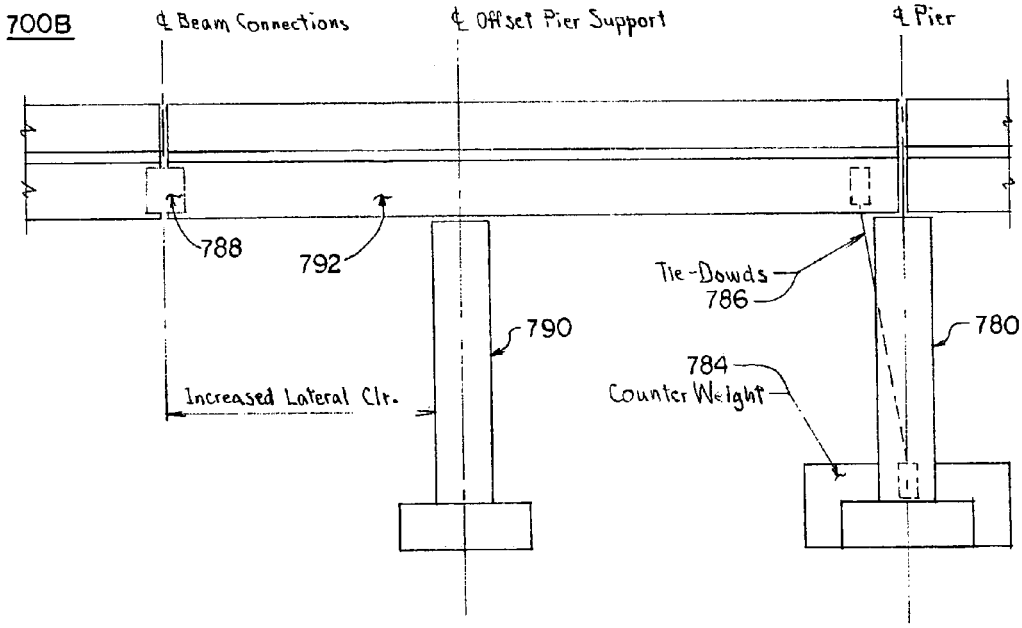
FIG. 7B illustrates the existing bridge span of FIG. 7A modified using this invention. It shows another way to construct the offset support system. For this example, bridge beam connections, tie-downs & counter weights are provided as required.

FIG. 7A illustrates an example, which shows one span of a multi-span traditional bridge with two supporting piers (780, 782) one at each end of beam of the span. FIG. 7B shows the pier (782) is necessary to be demolished for providing additional space for the adjacent span under the bridge. A longitudinally offset support substructure (790) is constructed at a desired offset location closer to pier (780) than the original configuration. The offset support could be a concrete wall, a concrete frame, a steel frame, a combination, etc. or any form or any construction material with sufficient strength and that meets the construction specifications. The new configuration changes the action of the existing bridge beams in the span. It creates a cantilever (or large negative moment and shear forces, for the case of continuous beam/girder) for the beam (792) over the new offset support (790). Therefore it is likely these beams (792) need to be modified or strengthened. At the original pier (782) location, the support for the adjacent span is demolished. Consequently, connections (788) tying the ends of cantilever (792) with the adjacent set of bridge span beams are necessary to provide the continuity (except for the case with continuous beam/girder). Furthermore, the extra load over the new substructure (790), from the adjacent set of bridge span beams for the case of cantilever or increased span length for the case with continuous beam/girder, may create an uplift load at the other beam end of the bridge span above pier (780). Tie-downs (786) and/or counter-weights (784) are constructed to counter-act the uplift as required

What is claimed:

1. A method of constructing a bridge, comprising:

constructing at least one offset support and a corresponding foundation for the offset support;

providing a superstructure;

providing at least one temporary support for fully or partially supporting the superstructure on a temporary basis;

constructing at least one cap beam or other structure for tying portions of the superstructure together and supporting the superstructure;

installing at least one link-support system between the cap beam or other structure and the offset support while the superstructure is supported at least in part by the temporary support;

transferring support of the superstructure from the temporary support to the offset support through the link-support system and the cap beam or other structure; and removing the temporary support.

2. The method as claimed in claim 1, wherein constructing at least one offset support comprises constructing a super-column.

3. The method as claimed in claim 1, wherein constructing at least one cap beam or other structure for tying portions of the superstructure together and supporting the superstructure comprises constructing the cap beam or other structure as an integral part of the superstructure.

4. The method as claimed in claim 1, wherein constructing at least one cap beam or other structure for tying portions of the superstructure together and supporting the superstructure comprises constructing the cap beam or other structure underneath or below the superstructure.

5. A method for increasing the lateral underclearance of an underpass located below the superstructure of a pre-existing bridge, the superstructure being supported by at least a first and a second pre-existing support positioned on opposite sides of the underpass, the method comprising:

constructing an offset support with a corresponding foundation so that the offset support is located laterally outward of the first pre-existing support in relation to the underpass;

constructing a cap beam or other structure for tying portions of the superstructure together and supporting the superstructure;

installing a link support system between the cap beam or other structure and the offset support so that the offset support supports the superstructure through the cap beam or other structure and the link support system; and demolishing the first pre-existing support.

6. The method of claim 5, further comprising:

constructing a second offset support with a corresponding foundation so that the second offset support is located laterally outward of the second pre-existing support in relation to the underpass;

constructing a second cap beam or other structure for tying portions of the superstructure together and supporting the superstructure;

installing a second link support system between the second cap beam or other structure and the second offset support so that the second offset support supports the superstructure through the second cap beam or other structure and the second link support system; and demolishing the second pre-existing support.

7. The method of claim 5, wherein constructing an offset support with a corresponding foundation comprises constructing a super-column.

8. The method of claim 5, wherein constructing an offset support with a corresponding foundation comprises constructing an abutment with a super-column.

9. The method of claim 8, farther comprising installing an extension beam between an end of a beam of the superstructure and the first pre-existing support.

10. The method of claim 9, wherein installing a link support system between the cap beam or other structure and the offset support further comprises installing the link support system between the abutment and the offset support so that the abutment foundation acts as a counterweight.

* * * * *